US011429033B2

(12) United States Patent
Nawa

(10) Patent No.: US 11,429,033 B2
(45) Date of Patent: Aug. 30, 2022

(54) CORONA CHARGING DEVICE CAPABLE OF SUPPRESSING OBSTRUCTION OF AN OPERATION OF A CARRIAGE

(71) Applicant: CANON KABUSHIKI KAISHA, Tokyo (JP)

(72) Inventor: Satoshi Nawa, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/194,700

(22) Filed: Mar. 8, 2021

(65) Prior Publication Data

US 2021/0278776 A1 Sep. 9, 2021

(30) Foreign Application Priority Data

Mar. 9, 2020 (JP) ..... JP2020-040246

(51) Int. Cl.
*G03G 15/02* (2006.01)

(52) U.S. Cl.
CPC ..... *G03G 15/0225* (2013.01); *G03G 15/0291* (2013.01)

(58) Field of Classification Search
CPC ..... G03G 15/0258; G03G 15/0291
USPC ..... 399/100
See application file for complete search history.

(56) References Cited

U.S. PATENT DOCUMENTS

| | | | | |
|---|---|---|---|---|
| 8,731,430 | B2 | 5/2014 | Hatano | |
| 8,837,977 | B2 * | 9/2014 | Tanaka | G03G 15/0291 399/100 |
| 9,851,653 | B2 * | 12/2017 | Kitagawa et al. | G03G 15/0258 |
| 10,156,806 | B2 * | 12/2018 | Fukuda | G03G 15/0291 |

FOREIGN PATENT DOCUMENTS

JP 2013-037123 A 2/2013

* cited by examiner

*Primary Examiner* — William J Royer
(74) *Attorney, Agent, or Firm* — Venable LLP

(57) ABSTRACT

A charging device for electrically charging a rotatable image bearing member includes a corona charger including a discharging wire, a rotatable rotation shaft provided along the discharging wire and provided with a helical groove on an outer peripheral surface thereof, a motor configured to rotate the rotation shaft, and a movable member including a projected portion engaging with the helical groove and mounted on the rotation shaft so as to be movable along the rotation shaft with rotation of the rotation shaft. In addition, a cleaning member is provided on the movable member to clean the discharging wire, and a brush member is provided on the movable member and configured to brush the helical groove.

18 Claims, 8 Drawing Sheets

CORONA CHARGING DEVICE CAPABLE OF SUPPRESSING OBSTRUCTION OF AN OPERATION OF A CARRIAGE

FIELD OF THE INVENTION AND RELATED ART

The present invention relates to a charging device optimum for use with an image forming apparatus such as a printer, a copying machine, a facsimile machine or a multifunction machine having a plurality of functions of these machines.

In the image forming apparatus of an electrophotographic type, as a charging device, a corona charger is used in some instances in order to electrically charge uniformly a surface of a photosensitive drum to a predetermined polarity and a predetermined potential. The corona charger is provided in non-contact with the photosensitive drum and charges the surface of the photosensitive drum by generating charged particles (corona ions) through corona electric discharge in response to application of a voltage to a discharging wire. However, when the discharging wire is contaminated with toner or the like, a lowering in charging efficiency of the photosensitive drum is caused, and a surface potential of the photosensitive drum becomes non-uniform, so that image defect called image non-uniformity can be caused to occur. Therefore, a corona charger for cleaning the discharging wire by a cleaning pad by moving a carriage provided with the cleaning pad in a reciprocation manner in a longitudinal direction (rotational axis direction of the photosensitive drum) of a screw by the screw capable of being rotated normally and reversely and thus the discharging wire is cleaned by the cleaning pad has been proposed (Japanese Laid-Open Patent Application (JP-A) 2013-37123).

In the case of the device disclosed in JP-A 2013-37123, a projected portion engaging with a helical groove of the screw is provided on the carriage, and the carriage is moved in the longitudinal direction of the screw by guiding the projected portion along the helical groove with rotation of the screw. For that reason, when toner, a dust and the like are deposited and accumulated in the helical groove of the screw (a load screw in this case), there arises a liability that motion of the carriage is obstructed.

SUMMARY OF THE INVENTION

A principal object of the present invention is to provide a charging device capable of suppressing obstruction of an operation of a carriage in the case of a constitution in which the carriage is moved in a longitudinal direction of the screw by guiding the projected portion along a helical groove of the screw.

According to an aspect of the present invention, there is provided a charging device for electrically charging a rotatable image bearing member, comprising: a corona charger including a discharging wire; a rotatable rotation shaft provided along the discharging wire and provided with a helical groove on an outer peripheral surface thereof; a motor configured to rotate the rotation shaft; a movable member including a projected portion engaging with the helical groove and mounted on the rotation shaft so as to be movable along the rotation shaft with rotation of the rotation shaft; a cleaning member provided on the movable member and configured to clean the discharging wire; and a brush member provided on the movable member and configured to brush the helical groove.

Further features of the present invention will become apparent from the following description of exemplary embodiments with reference to the attached drawings.

DESCRIPTION OF EMBODIMENTS

<Image Forming Apparatus>

A general structure of an image forming apparatus will be described using FIGS. 1 and 2. An image forming apparatus 100 in this embodiment is a full-color tandem printer of an electrophotographic type. The image forming apparatus 100 includes first to fourth image forming portions PY, PM, PC and PK for forming images of yellow, magenta, cyan and black, respectively. The image forming apparatus 100 is capable of forming a toner image on a recording material in accordance with an image signal sent from an original reading device (not shown) connected with an apparatus main assembly 100A thereof and controlled by a controller 300, an external device such as a personal computer or the like connected communicatably with the apparatus main assembly 100A, or from the like device. As the recording material, it is possible to use a sheet material such as a sheet, a plastic film or a cloth.

Figure 1:
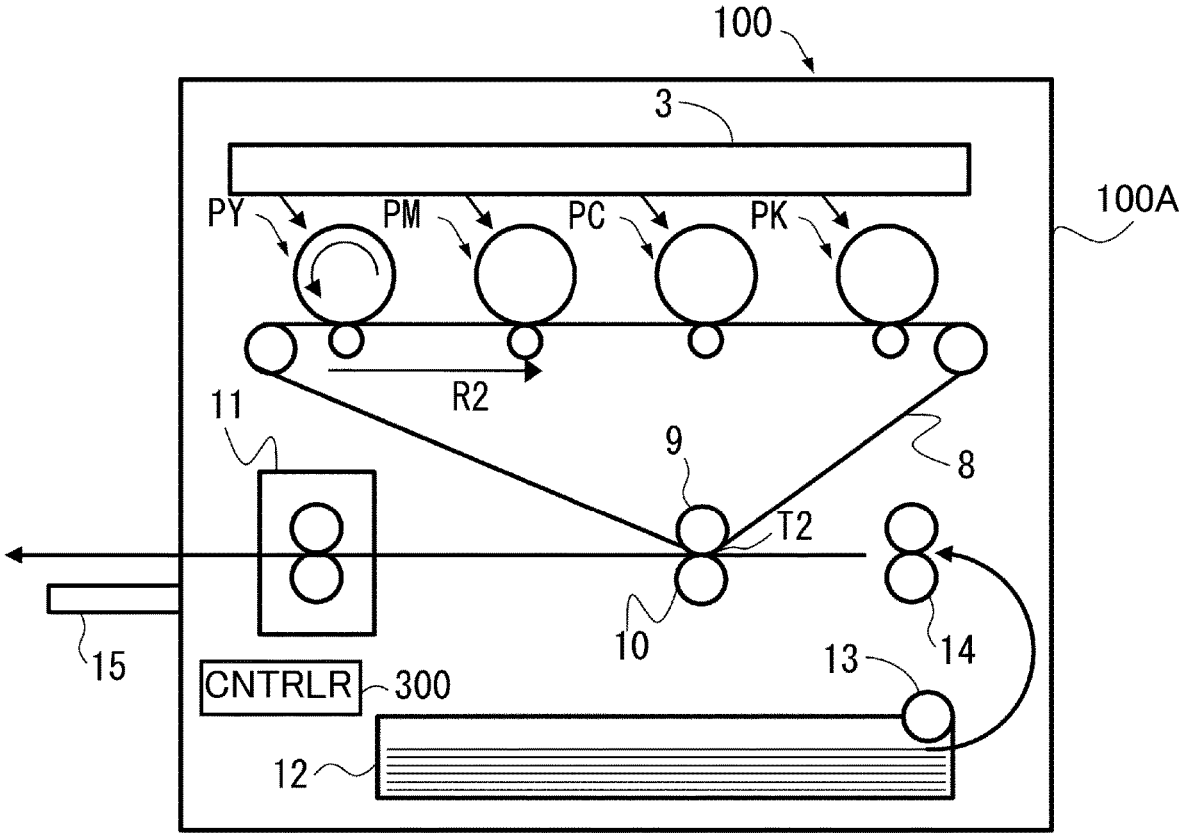
FIG. 1 is a schematic view showing a structure of an image forming apparatus.

As shown in FIG. 1, the image forming portions PY, PM, PC and PK are provided and arranged along a movement direction of an intermediary transfer belt 8. The intermediary transfer belt 8 is stretched by a plurality of rollers and is constituted so as to be moved in an arrow R2 direction. The intermediary transfer belt 8 carries and feeds a toner image primary-transferred in a manner described later. At a position opposing a roller 9 for stretching the intermediary transfer belt 8 through the intermediary transfer belt 8, a secondary transfer roller 10 is provided, and a secondary transfer portion T2 where the toner image is transferred from the intermediary transfer belt 8 onto a recording material is constituted.

At a lower portion of the image forming apparatus 100, a cassette 12 in which recording materials are accommodated is provided. The recording material is fed from the cassette 12 toward a registration roller pair 14 by a feeding roller 13. Thereafter, the registration roller pair 14 starts rotation in synchronism with the toner image on the intermediary transfer belt 8.

The four image forming portions PY to PK of the image forming apparatus 100 have substantially the same constitution except that colors of the respective developers are different from each other. Therefore, in this embodiment, the image forming portion PK will be described as a representative example, and other image forming portions PY, PM and PC will be omitted from description.

Figure 2:
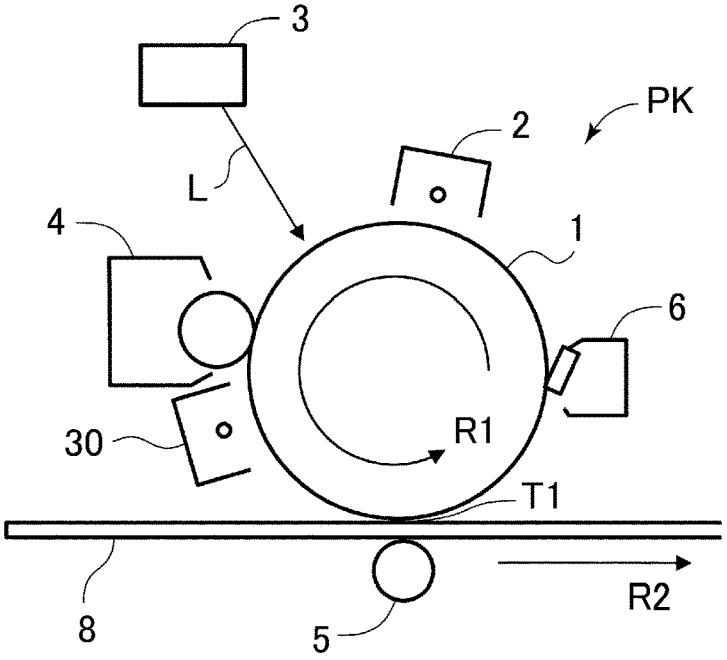
FIG. 2 is a schematic view showing a structure of an image forming portion.

As shown in FIG. 2, in the image forming portion PK, as an image bearing member, a cylindrical photosensitive member, i.e., a photosensitive drum 1 is provided. The photosensitive drum 1 is rotationally driven in an arrow R1 direction in the figure. At a periphery of the photosensitive drum 1, a charger (first charging device) 2, an exposure device 3, a developing device 4, a post-charging device (second charging device) 30, a primary transfer roller 5 and a cleaning device 6 are provided.

A process for forming, for example, a four-color based full-color image by the image forming apparatus 100 constituted as mentioned above will be described.

First, when an image forming operation is started, a surface of the photosensitive drum 1 is electrically charged uniformly by the charger 2. As the charger 2, a corona charger for uniformly charging the photosensitive drum 1 to a negative dark-part potential by irradiating the photosensitive drum 1 with charged particles with corona (electric) discharge is used.

Then, the photosensitive drum 1 is subjected to scanning exposure to laser light L corresponding to an image signal sent from the exposure device 3. As a result, the electrostatic latent image depending on the image signal is formed on the photosensitive drum 1. The electrostatic latent image formed on the photosensitive drum 1 is visualized (developed) into a visible image (toner image) by toner accommodated in the developing device 4. Thereafter, the toner image formed on the photosensitive drum 1 is subjected to adjustment of a charge amount by the post-charging device 30 in order to uniformize a toner charge amount for each of the colors.

In the case of this embodiment, the corona charger is also used as the post-charging device 30. The post-charging device 30 is provided so as to be insertable in and extractable from the apparatus main assembly 100A (see FIG. 1) of the image forming apparatus 100, and is disposed at a position opposing the photosensitive drum 1 along a rotational axis direction (longitudinal direction) of the photosensitive drum 1. A structure of the post-charging device 30 will be described later (see FIGS. 3 to 5).

The toner image which is formed on the photosensitive drum 1 and of which charge amount is adjusted is primary-transferred onto the intermediary transfer belt 8 at a primary transfer portion T1 formed (constituted) between the photosensitive drum 1 and the intermediary transfer belt 8 sandwiched between the photosensitive drum 1 and the primary transfer roller 5. At this time, to the primary transfer roller 5, a primary transfer bias is applied. Toner and the like remaining on the surface of the photosensitive drum 1 after primary transfer are removed by the cleaning device 6.

Such an operation is successively performed in the image forming portions for yellow, magenta, cyan and black, so that full-color toner images are superposed on the intermediary transfer belt 8. Thereafter, the recording material accommodated in the cassette 12 is fed to the secondary transfer portion T2 in synchronism with the toner image formation timing.

Then, by applying a secondary transfer bias to the secondary transfer roller 10, the four color toner images are secondary-transferred collectively from the intermediary transfer belt 8 onto the recording material.

The recording material is then fed to a fixing device 11. The fixing device 11 heats and presses the four color toner images onto the fed recording material. As a result, the toner on the recording material is melted and mixed and thus is fixed as a full-color image on the recording material. Thereafter, the recording material is discharged onto a discharge tray 15. Thus, a series of image forming process operations is ended.

<Post-Charging Device>

Next, an outline of the post-charging device 30 in this embodiment will be described using FIGS. 3 to 5 while making reference to FIG. 2. As shown in FIG. 4, the post-charging device 30 includes a discharging wire 52 imparting electric charges to the toner image on the photosensitive drum 1 and shield plates (shield electrodes) 53 forming an opening 54 on a side opposing the photosensitive drum 1 and provided so as to enclose three directions (sides) of the discharging wire 52. The shield plates 53 are formed of, for example, stainless steel (SUS), and the discharging wire 52 is extended in a longitudinal direction of the post-charging device 30 so as to be sandwiched between opposing two shield plates 53.

Figure 3:
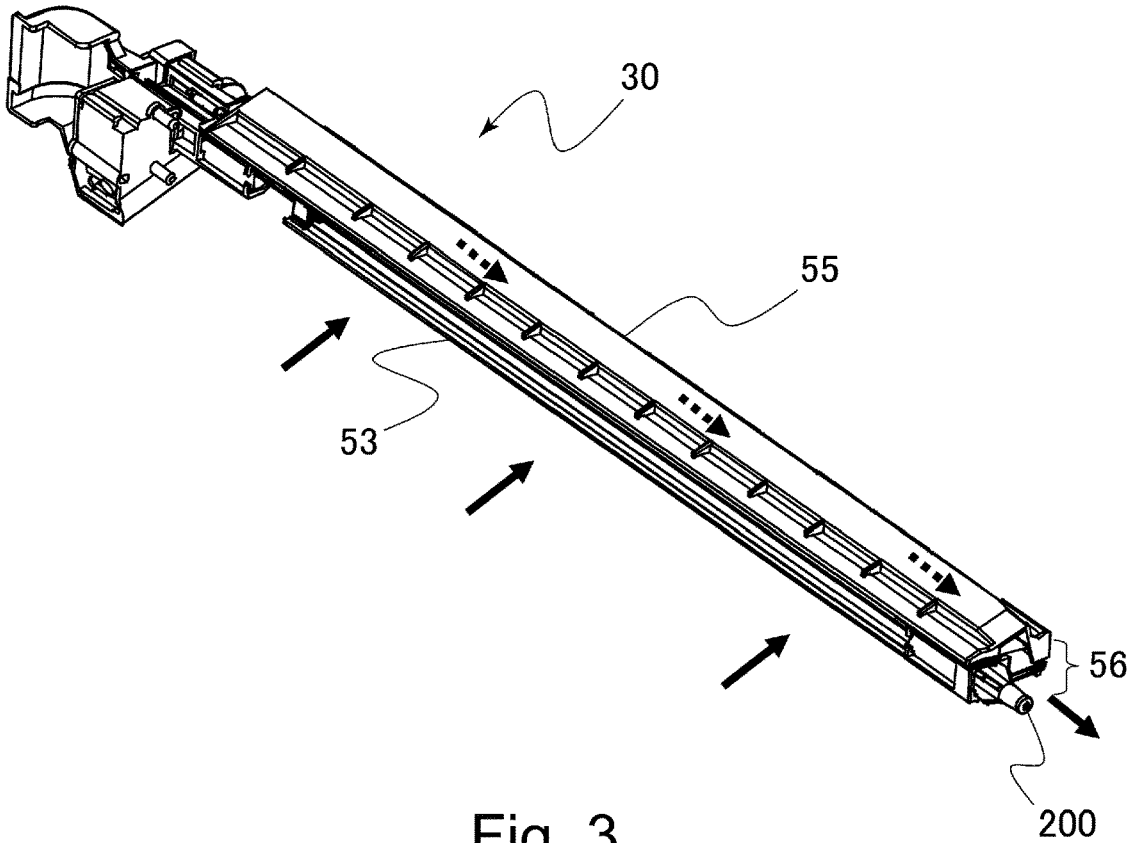
FIG. 3 is a perspective view showing an outer appearance of a post-charging device.
Figure 4:
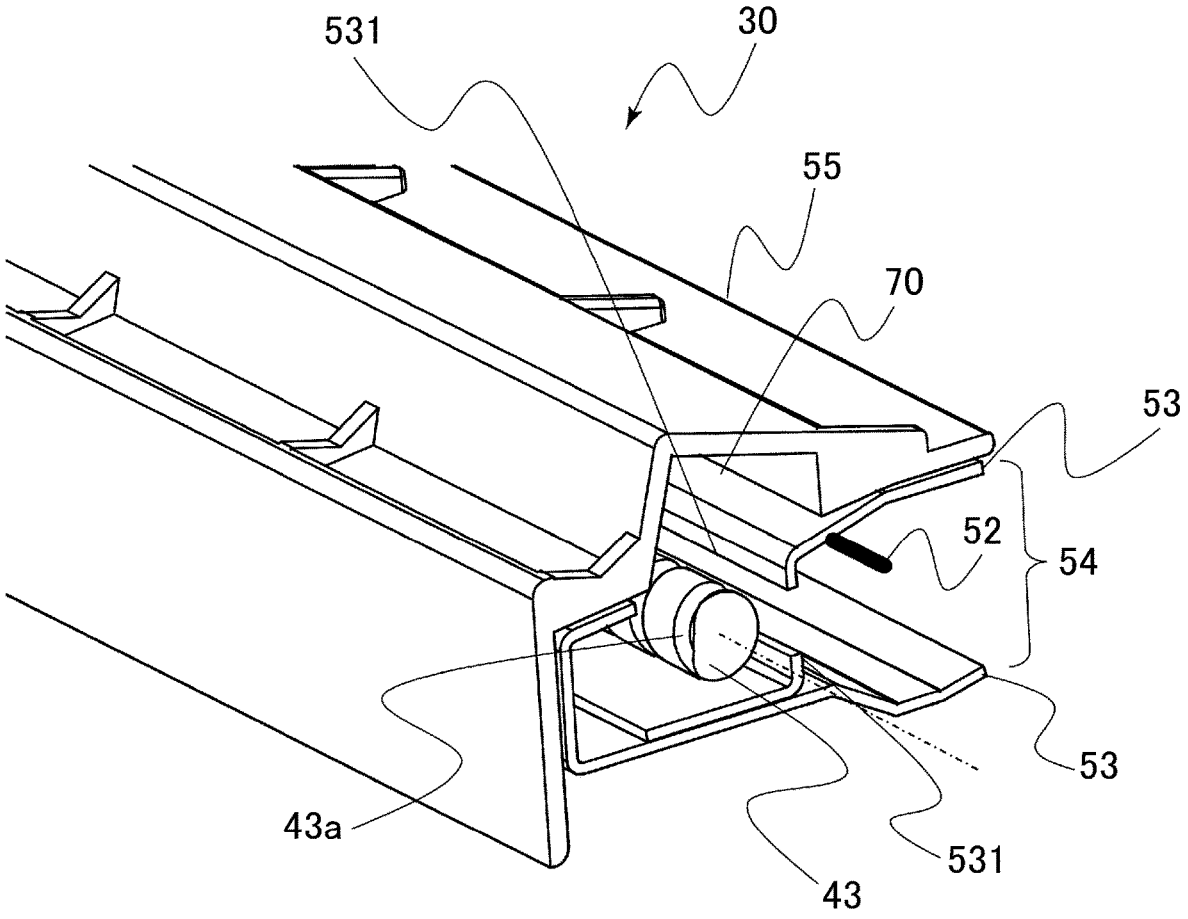
FIG. 4 is a schematic view showing a structure of the post-charging device.

Further, the post-charging device 30 includes, as shown in FIG. 3, a high-voltage contact (point) 200 supplied with a high voltage from a high-voltage source (not shown) of the apparatus main assembly 100A. The discharging wire 52 is capable of corona (electric) discharge by flowing of a current depending on energization from the high-voltage source of the apparatus main assembly 100A through the high-voltage contact 200. The discharging wire 52 is formed in a wire shape by using, for example, stainless steel, nickel, molybdenum tungsten or the like. The discharging wire 52 is formed so as to have a diameter of 40 μm to 100 μm, for example.

As shown in FIG. 4, by the post-charging device 30, a screw 43 (lead screw) provided with a helical groove 43*a* formed on an outer peripheral surface of a round shaft thereof is rotatably supported on opposite end portion sides with respect to the longitudinal direction of the post-charging device 30. With the screw 43 as a rotatable member, a carriage 50 (see FIG. 5) formed of an ABS resin material, a polycarbonate resin material or the like is loosely engaged so as to be movable. The carriage 50 as a movable member is guided, through a carriage guide 50*a* (see FIG. 7), by shield plate rails 531 formed by bending the opposing shield plates 53 so as to face each other, so that the carriage 50 is reciprocated along the longitudinal direction of the screw 43.

Figure 5:
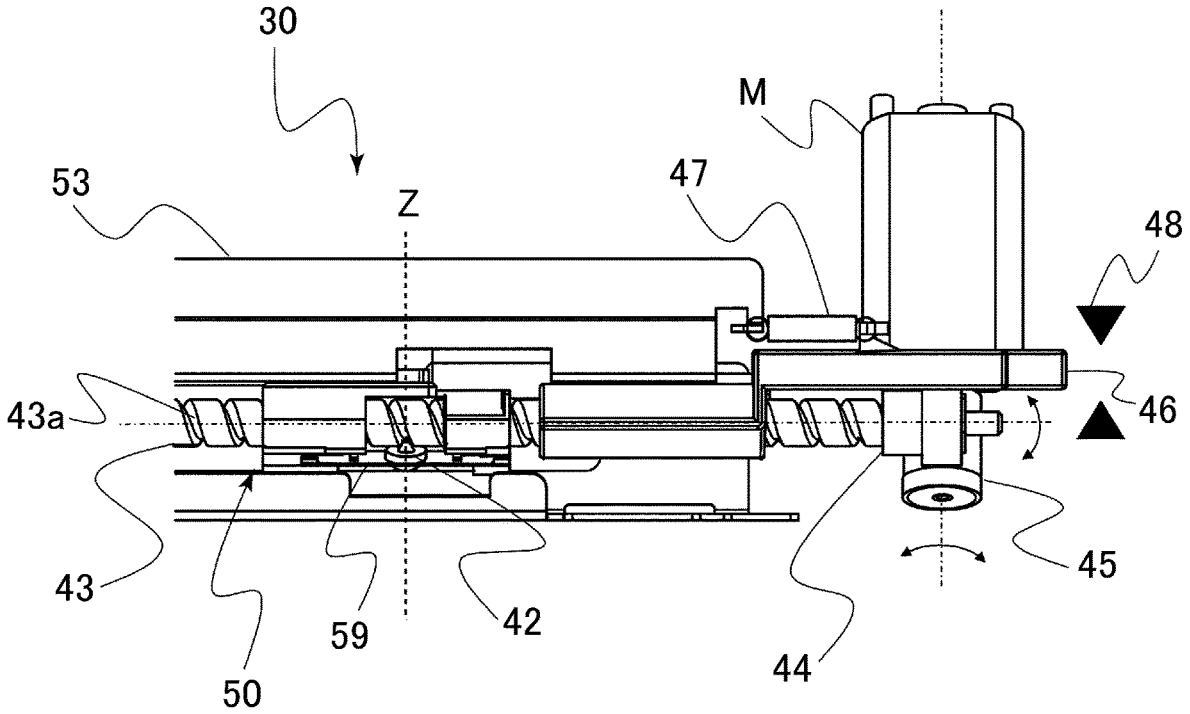
FIG. 5 is a top plan view for illustrating an operation mechanism of a carriage.

Further, as shown in FIG. 5, the carriage 50 is provided with a projected portion 42 formed, as an engaging portion, of a non-electroconductive resin material so as to project toward the screw 43, and the projected portion 42 is engaged with a helical groove 43*a* (portion-to-be-engaged) of the screw 43. Further, the projected portion 42 is mounted on a leaf spring 59 as an urging member, and the leaf spring 59 is supported by the carriage 50. The projected portion 42 is urged toward the screw 43 by the leaf spring 59. Thus, the projected portion 42 is elastically supported by the carriage 50 through the leading spring 59, so that the projected portion 42 is maintained in a state in which the projected portion 42 is engaged with the helical groove 43*a* of the screw 43 even during movement of the carriage 50. A height from a surface of the screw 43 providing a longitudinal driving force to the carriage 50 to a bottom of the helical groove 43*a* as the portion-to-be-engaged, i.e., a depth of the helical groove 43*a* is set at 1.5 mm, for example. Incidentally, the screw 43 may also be one formed by providing helical projections on a round shaft.

As shown in FIG. 5, the carriage 50 is driven in the longitudinal direction of the screw 43 by rotation of a driving gear 44 mounted on the screw 43. The driving gear 44 is rotationally driven by a worm gear 45 provided so that rotational axes thereof are perpendicular to each other. The worm gear 45 is rotated normally and reversely by a motor M. By this, rotation (rotational force) of the motor M is transmitted in the order of the worm gear 45, the driving gear 44 and the screw 43, and thus the screw 43 is rotated normally and reversely, so that the carriage 50 is reciprocated.

The carriage 50 is retracted to a retracted position (also called a home position) where the carriage 50 is shifted to one end side of the screw 43 with respect to the longitudinal direction so as not to obstruct charging of the photosensitive drum 1 at a time other than cleaning of the discharging wire 52. In order to detect whether or not the carriage 50 is in the retracted position, as shown in FIG. 5, the post-charging device 30 is provided with an optical sensor 48. The optical sensor 48 is used for detecting whether or not the carriage 50 is in the retracted position, and although omitted from illustration, for example, a sensor of a photo-interrupt type in which a light emitting portion for emitting light to a detecting position and a light receiving portion for receiving the light emitted from the light emitting portion or the like sensor is used.

In the case where the sensor of the photo-interrupt type is used, a shielding member 46 is provided over the screw 43 so as to be movable in the same direction as a movement direction of the carriage 50 in response to movement of the carriage 50. In the case where the shielding member 46 is in a shielding position where the optical sensor 48 is shielded by the shielding member 46, the carriage 50 is in the retracted position, and on the other hand, in the case where the shielding member 46 is in a non-shielding position where the shielding member 46 does not shield the optical sensor 48, the carriage 50 is not in the retracted position. In the case of this embodiment, the retracted position of the carriage 50 is on the optical sensor 48 side. Further, on the shielding member 46, a compression spring 47 is mounted, and in the case where the carriage 50 is moved to the optical sensor 48 side, the compression spring 47 is pressed, so that the shielding member 46 is moved to the shielding position where the shielding member 46 shields the optical sensor 48. On the other hand, in the case where the carriage 50 is moved to a side opposite to the optical sensor 48 side, the pressed compression spring 47 is returned to an original position, so that the shielding member 46 is moved to a non-shielding P where the shielding member 46 does not shield the optical sensor 48.

Further, the post-charging device 30 in this embodiment includes, as shown in FIG. 3, an air duct 55 extended in the longitudinal direction. A passage shown by arrows in FIG. 3 represents an air flow passage in the post-charging device 30. By providing the air duct 55, the air sucked through the opening 54 formed by the plurality of shield plates 53 on a side opposing the photosensitive drum 1 passes through an air flow passage 70 (see FIG. 4) in the post-charging device 30 and then is discharged through an opening 56 formed on one end side with respect to the longitudinal direction. That is, the air duct 55 forms the air flow passage 70 as the air flow passage through which the air inside the post-charging device 30 is discharged from the one end portion side with respect to the longitudinal direction. The screw 43 is disposed in the air duct 55 (see FIG. 4).

The opening 56 communicates with a main assembly-side air duct which is provided in the apparatus main assembly 100A of the image forming apparatus 100 and which includes an air discharging fan, an ozone filter, a toner filter and the like although these members are omitted from the figures. That is, ozone generated by the corona discharge of the post-charging device 30 and scattered toner generated in the neighborhood of the developing device 4 (see FIG. 2) are discharged from the opening 56 through the above-described air flow passage 70 and then are collected by the ozone filter and the toner filter when passing through the main assembly-side air duct.

Figure 6:
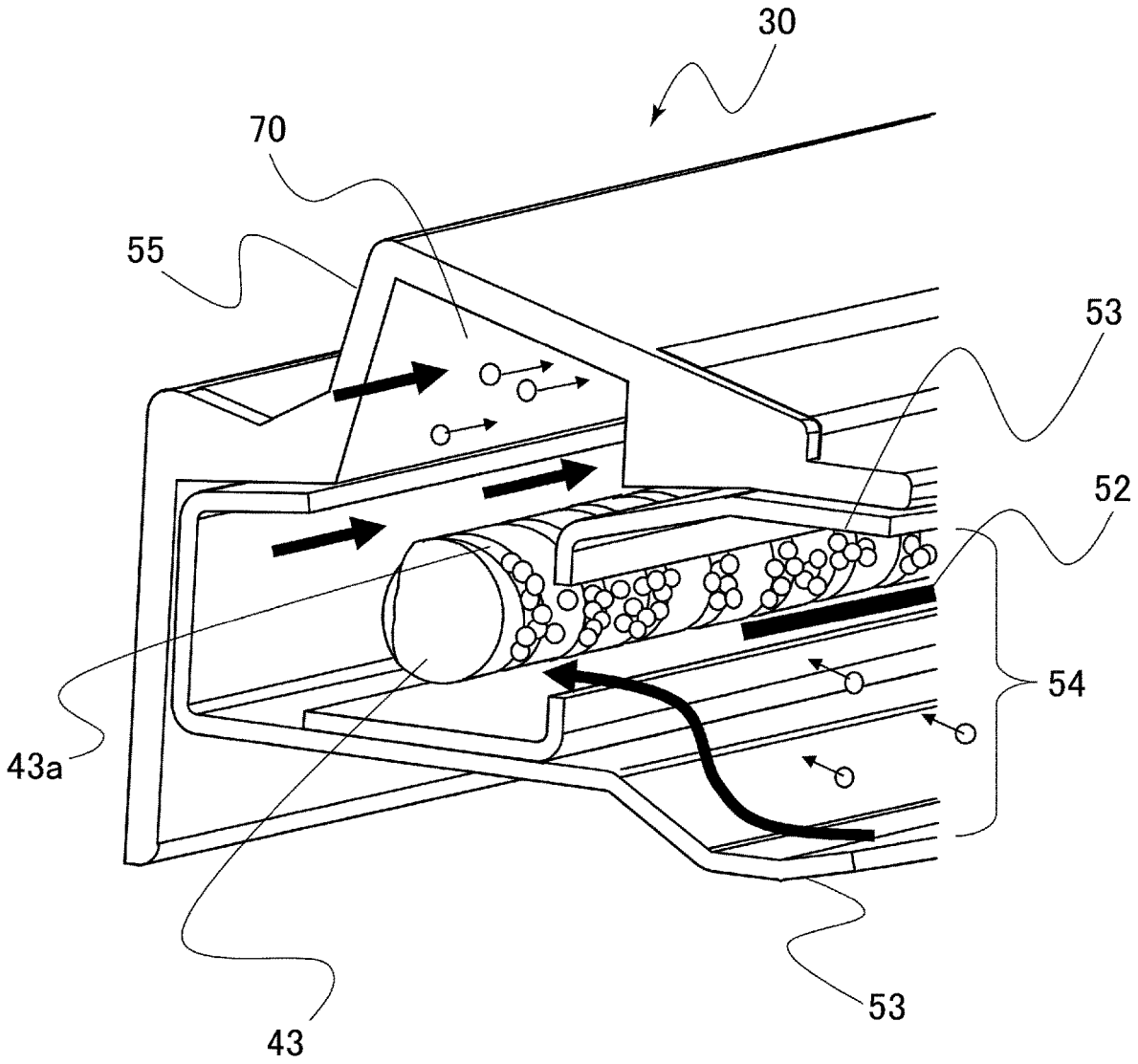
FIG. 6 is a schematic view for illustrating contamination of a screw.

Incidentally, the scattered toner generated during image formation or the like and dust on an outside of the apparatus main assembly 100A enter, together with the air sucked through the opening 54, the post-charging device 30 as shown in FIG. 6, and is capable of passing through the air flow passage 70 of the air duct 55 while floating in the post-charging device 30. However, at that time, a part of the toner and the dust is deposited on the screw 43 and remains as a deposited matter. Particularly, the deposited matter such as the toner, the dust or the like which are deposited in the helical groove 43*a* of the screw 43 is liable to accumulate in the helical groove 43*a*. Conventionally, in order to clean the discharging wire 52, the carriage 50 was moved by rotating the screw 43 while the deposited matter such as the toner, the dust or the like was deposited in the helical groove 43*a*. In that case, a free end of the projected portion 42 is abraded by the deposited matter interposed between the projected portion 42 of the carriage 50 and the helical groove 43*a* of the screw 43, so that a projection length of the projected portion 42 is liable to gradually become shorter.

However, when the projection length of the projected portion 42 becomes shorter, the projected portion 42 is liable to be disengaged from the helical groove 43*a*, so that improper operation of the carriage 50 can occur. Or, with movement of the carriage 50 from one end side toward the other end side of the screw 43, the toner, the dust or the like is collected by the projected portion 42, so that an accumulation amount thereof in the helical groove 43*a* increases. With an increasing amount of the toner, the dust or the like accumulated in the helical groove 43*a*, this constitutes a larger resistance and thus smooth movement of the projected portion 42 cannot be realized, so that the improper operation of the carriage 50 can occur.

In view of the above-described problems, in this embodiment, with movement of the carriage 50, the deposited matter such as the toner, the dust or the like was capable of being removed from the helical groove 43*a* of the screw 43. In the following, the carriage 50 in this embodiment will be described using FIGS. 7 to 9 while making reference to FIGS. 4 and 5.

<Detailed Structure of Carriage>

Figure 7:
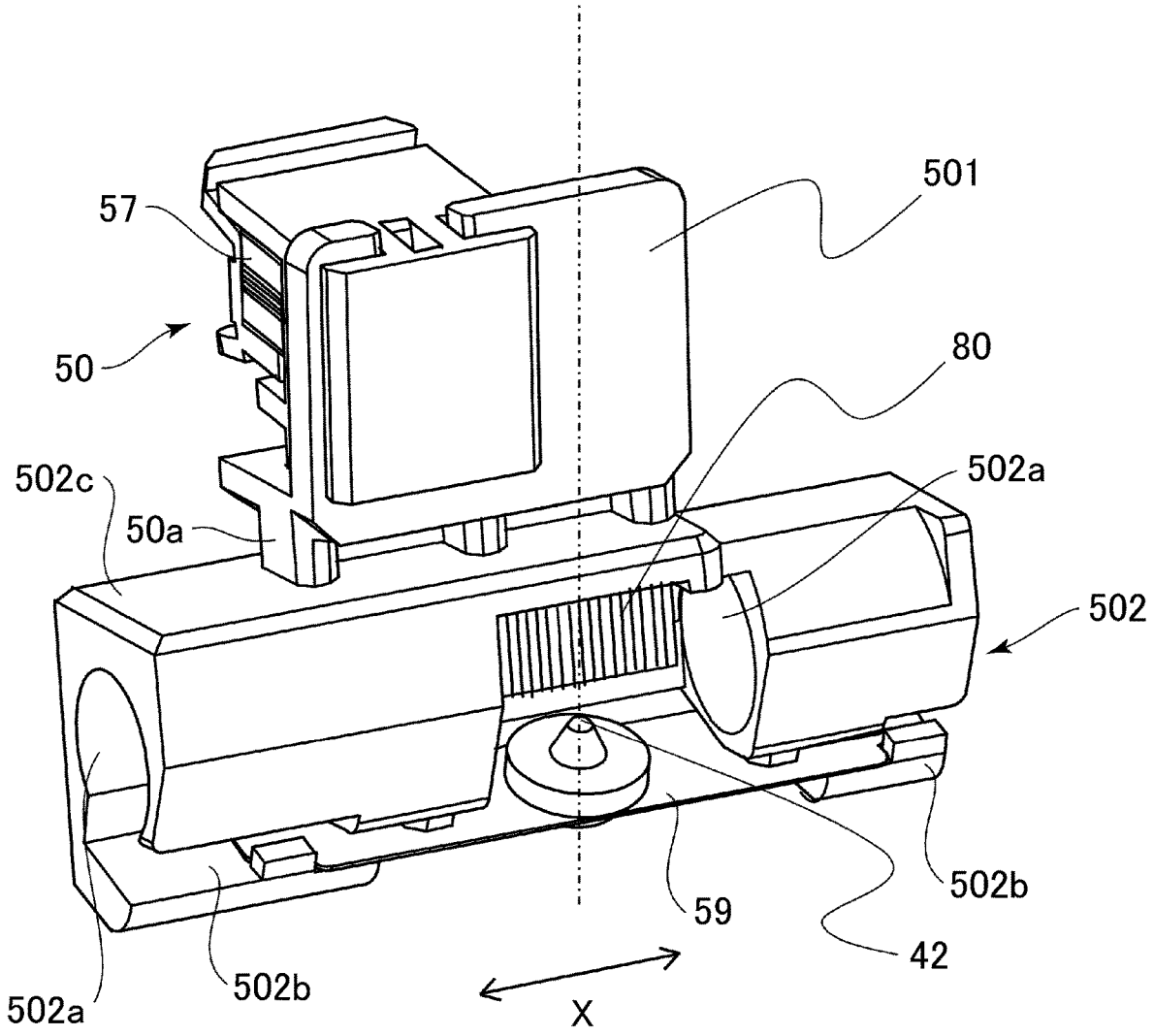
FIG. 7 is a perspective view showing a carriage in an embodiment as viewed from an upper surface side.

As shown in FIG. 7, the carriage 50 is provided with a cleaning pad 57 for cleaning the discharging wire 52, and the cleaning pad 57 is mounted on a pad mounting holder 501. The cleaning pad 57 as a cleaning member is reciprocated in the longitudinal direction while rubbing the discharging wire 52 with movement of the carriage 50 depending on drive of the motor M. The cleaning pad 57 is formed of, for example, a sponge and cleans the discharging wire 52 by being reciprocated in a state in which the cleaning pad 57 sandwiches the discharging wire 52 from opposite sides of the discharging wire 52. Incidentally, the cleaning pad 57 may be provided on the pad mounting holder 501 so as to be freely exchangeable.

The carriage 50 includes, in addition to the pad mounting holder 501, a main body portion 502 formed in a shape partially enclosing the screw 43 and mounted on the screw 43 in a loosely engaged state. That is, the main body portion 502 is provided with a through hole 502*a* extending in the longitudinal direction, and the screw 43 is passed through the through hole 502*a*. The through hole 502*a* is formed so that a diameter thereof is larger than an outer diameter of the screw 43, so that the carriage 50 is loosely engaged with the screw 43 so as to be movable relative to the screw 43. Further, the main body portion 502 and the pad mounting holder 501 are connected to each other by the carriage guide 50*a*, so that guidance of the carriage 50 by the shielding plate rails 531 (see FIG. 4) is enabled.

On the main body portion 502, not only the projected portion 42 and the leaf spring 59 are mounted, but also a cleaning member 80, such as a cleaning brush, as a removing member is mounted. The cleaning brush is a brush member including a plurality of brushes made of resin materials such as polyamide synthetic resin, polyvinyl chloride (PVC) and polyphenylene sulfide (PPS). Or, the cleaning member 80 is not limited to the brush shaped member, but may also be a pad shaped member formed by an elastic member such as felt or sponge for example.

Figure 9:
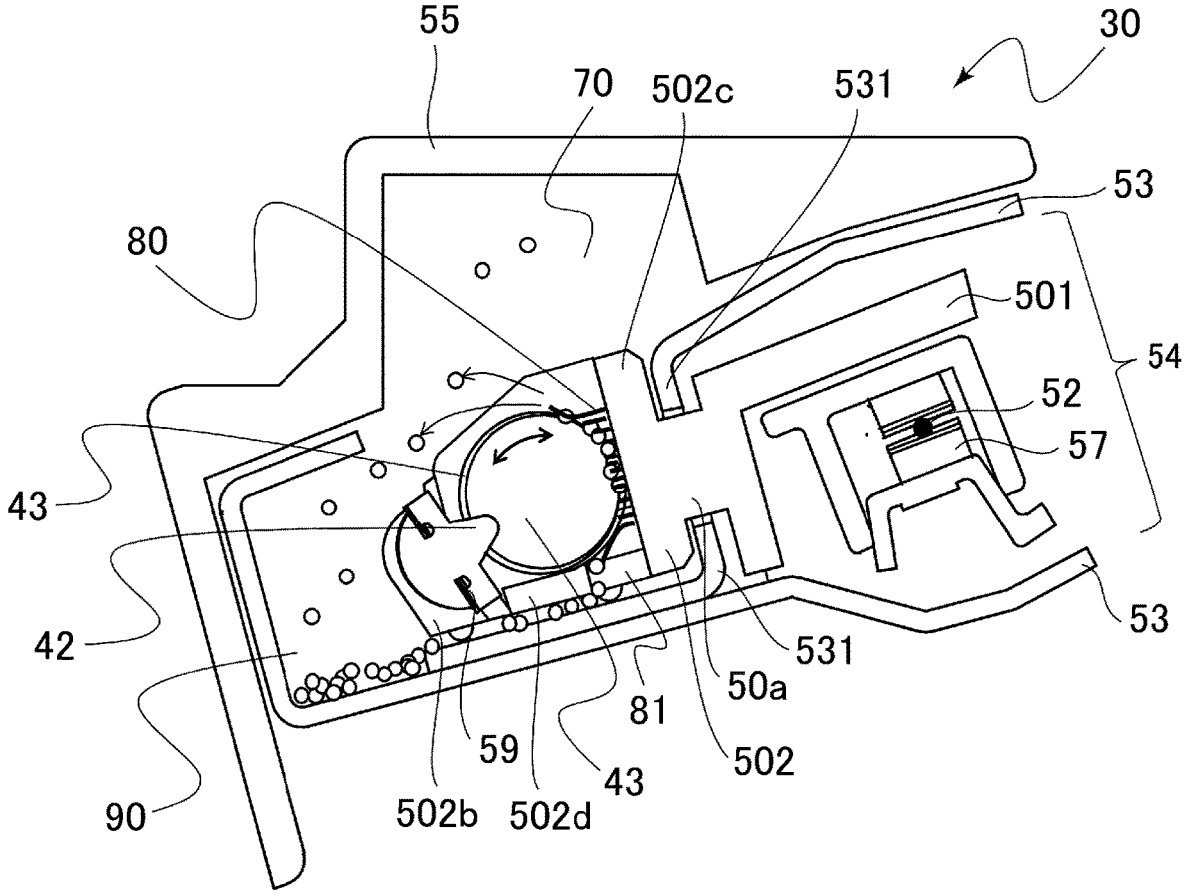
FIG. 9 is a sectional view showing the carriage in this embodiment.

In the case of this embodiment, in the state in which the carriage 50 is loosely engaged with the screw 43, as shown in FIG. 9, the cleaning brush is disposed on the main body portion 502 so that free ends of the cleaning brush contact the screw 43 from a side opposite from the projected portion 42 through the screw 43. That is, the cleaning brush is disposed opposed to the projected portion 42 while sandwiching the screw 43 therebetween. Further, as described above, the projected portion 42 is urged toward the screw 43 by the leaf spring 59. Therefore, the screw 43 presses the cleaning brush, so that the free ends of the cleaning brush reach the bottom of the helical groove 43*a* of the screw 43 with reliability and thus can contact (brush) the helical groove 43*a*.

The cleaning brush moves together with the carriage 50 in the longitudinal direction depending on the rotation of the screw 43. At that time, the cleaning brush brushes the surface of the rotating screw 43 and the helical groove 43*a* with the plurality of brushes projecting toward the screw 43, and thus removes the deposited matter such as the toner, the dust or the like deposited on the screw 43. Further, the cleaning brush can also remove a carrier in a constitution using a two-component developer. The cleaning brush is capable of retaining the deposited matter removed from the screw 43 in a certain amount.

The cleaning brush is formed, as shown in FIG. 7, so as to include the free end of the projected portion 42 as viewed from a widthwise direction (which is the same direction as a direction in which the projected portion 42 projects) in which the projected portion 42 crosses the longitudinal direction (movement direction: arrow X direction in the figure) of the carriage 50. That is, even when the carriage 50 moves in either direction, the cleaning brush is formed in a length with respect to the longitudinal direction so as to brush the helical groove 43*a* of the screw 43 earlier than the free end of the projected portion 42. In the case of this embodiment, when the carriage 50 is moved, the cleaning brush may only be required to be formed so as to brush the helical groove 43*a* on a side downstream, with respect to the movement direction of the carriage 50, at least an engaging position Z (see FIG. 5) where the projected portion 42 engages with the helical groove 43*a*.

Further, the main body portion 502 opposes, through the screw 43, mounting portions 502*b* mounted so as to bridge the leaf spring 59 therebetween and includes a first wall surface portion 502*c* on which the cleaning brush described above is mounted. This first wall surface portion 502*c* is provided so as to prevent movement of the deposited matter, such as the toner or the dust removed from the screw 43 by the cleaning brush, toward the discharging wire 52 side, by extension toward the photosensitive drum 1 side (photosensitive member side: see FIG. 2). That is, when the first wall surface portion 502*c* is provided between the cleaning brush and the photosensitive drum 1, it is possible to suppress deposition of the removed deposited matter on the discharging wire 52 and the photosensitive drum 1.

Figure 8:
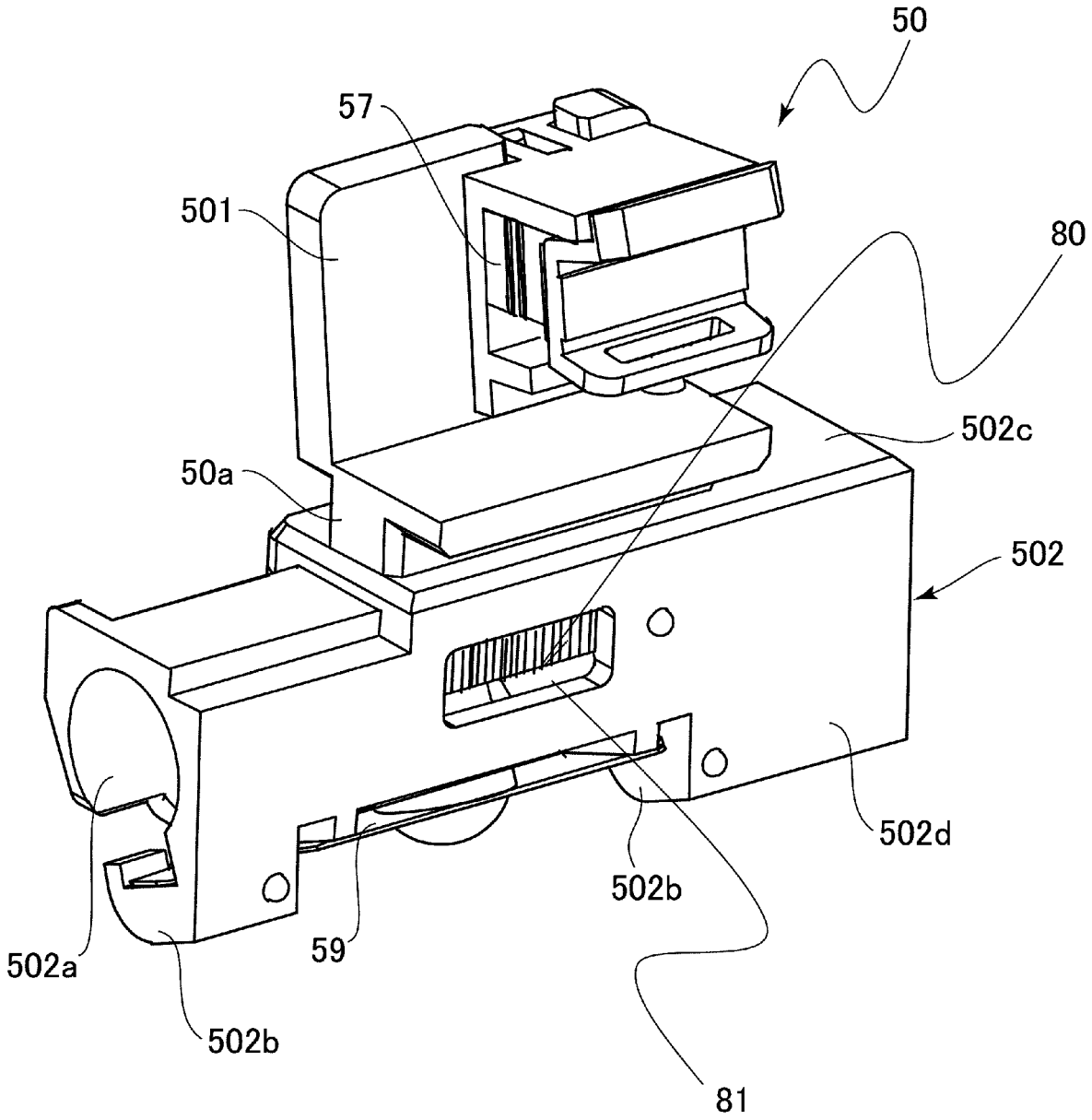
FIG. 8 is a perspective view showing the carriage in the embodiment as viewed from a lower surface side.

Further, the main body portion 502 includes, as shown in FIG. 8, a second wall surface portion 502*d* integrally formed with the mounting portions 502*b* so as to connect the mounting portions 502*b* with the first and second wall surface portions 502*c* and 502*d*. The second wall surface portion 502*d* is provided with a discharge opening 81 for permitting discharge of the deposited matter removed from the screw 43 by the cleaning brush. As shown in FIG. 8, the discharge opening 81 is formed immediately under the cleaning member 80 in a size such that the discharge opening 81 overlaps with at least a part of the cleaning member 80 with respect to the longitudinal direction. Further, as shown in FIG. 9, the discharge opening 81 is formed under the cleaning member 80 with respect to a direction of the gravitation in a size including from a base portion to the free ends of the cleaning member 80 as viewed in the widthwise direction crossing the longitudinal direction.

The deposited matter removed through the discharge opening 81 is discharged from the main body portion 502 and collected in collection area 90, so that it is possible to suppress the deposited matter from remaining in the main body portion 502 and being deposited on the screw 43 again. Further, in the case of this embodiment, the discharge opening 81 communicates with the air duct 55. Therefore, the removed deposited matter is discharged from the opening 56 through the air flow passage 70 of the air duct 55 and is collected by the toner filter of the main assembly side airduct.

As described above, in this embodiment, in the case of a constitution in which the carriage 50 is moved in the longitudinal direction of the screw 43 by guiding the projected portion 42 along the helical groove 43*a* of the screw 43, the cleaning member 80 for cleaning the screw 43 was provided on the carriage 80. The cleaning member 80 enters the helical groove 43*a* of the screw 43 and is capable of removing the deposited matter, such as the toner or the dust, deposited on the helical groove 43*a*. Thus, the deposited matter can be removed from the helical groove 43*a* by the cleaning member 80, so that suppression of abrasion of the projected portion 42 which can occur due to the presence of the deposited matter between the projected portion 42 and the helical groove 43*a* can be realized with a simple constitution.

Further, the cleaning member 80 is provided on the carriage 50 on which the cleaning pad 57 for cleaning the discharging wire 52 is mounted, and is moved together with the cleaning pad 57, so that it is possible to realize cleaning of the helical groove 43*a* without upsizing the carriage 50.

Incidentally, in the above-described embodiment, the case where the single cleaning brush is provided was described as an example, but the present invention is not limited thereto. For example, two cleaning brushes may also be provided so as to sandwich the projected portion 42 with respect to the longitudinal direction. Or, the cleaning brush may also be disposed only on a side downstream or upstream of the projected portion 42 with respect to the movement direction of the carriage 50. However, when the cleaning brush is disposed as in the above-described embodiment, the deposited matter can be preferably removed efficiently.

Incidentally, in the above-described embodiment, the case where the present invention is applied to the post-charging device 30 was described as an example, but the present invention may also be applied to the charger 2. However, the post-charging device 30 is provided with the air duct 55 and is disposed below the developing device 4 with respect to the direction of the gravitation, so that the toner, the dust and the like are liable to be deposited on the screw 43 in the post-charging device 30 compared with the case of the charger 2. Therefore, in the present invention, a larger effect is readily achieved in the case where the present invention is applied to the post-charging device 30 than to the charger 2.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-040246 filed on Mar. 9, 2020, which is hereby incorporated by reference herein in its entirety.

What is claimed is:

1. A charging device for electrically charging a rotatable image bearing member, comprising:

a corona charger including a discharging wire;

a rotatable rotation shaft provided along said discharging wire and provided with a helical groove on an outer peripheral surface thereof;

a motor configured to rotate said rotation shaft;

a movable member including a projected portion engaging with said helical groove and mounted on said rotation shaft so as to be movable along said rotation shaft with rotation of said rotation shaft;

a cleaning member provided on said movable member and configured to clean said discharging wire; and a brush member provided on said movable member and configured to brush said helical groove.

2. A charging device according to claim 1, wherein when said movable member moves, said brush member brushes said helical groove at least on a side downstream of an engaging position of said projected portion with said helical groove with respect to a movement direction of said movable member.

3. A charging device according to claim 1, wherein said brush member is disposed so as to face said projected portion through said rotation shaft.

4. A charging device according to claim 1, wherein said movable member includes an urging member configured to urge said projected portion toward said rotation shaft.

5. A charging device according to claim 1, wherein said corona charger includes an air duct forming a flow passage through which inside air thereof is discharged from one end side with respect to a longitudinal direction thereof, and wherein said rotation shaft is disposed inside of said air duct.

6. A charging device according to claim 5, wherein said movable member communicates with said air duct and is provided with a discharge opening through which a deposited matter removed from said helical groove is discharged into said air duct.

7. A charging device according to claim 6, wherein said discharge opening of said movable member is formed below said brush member with respect to a direction of gravitation.

8. A charging device according to claim 1, wherein said projected portion of said movable member is formed of a non-electroconductive resin material.

9. An image forming apparatus comprising:

a rotatable image bearing member;

a charging device according to claim 1;

a developing device configured to develop an electrostatic latent image formed on said rotatable image bearing member; and a transfer member configured to transfer a toner image formed on said rotatable image bearing member, wherein said charging device is provided downstream of said developing device and upstream of said transfer member with respect to a rotational direction of said rotatable image bearing member.

10. A charging device for electrically charging a rotatable image bearing member, comprising:

a corona charger including a discharging wire;

a rotatable rotation shaft provided along said discharging wire and provided with a helical groove on an outer peripheral surface thereof;

a motor configured to rotate said rotation shaft;

a movable member including a projected portion engaging with said helical groove and mounted on said rotation shaft so as to be movable along said rotation shaft with rotation of said rotation shaft;

a cleaning member provided on said movable member and configured to clean said discharging wire; and an elastic member provided on said movable member and configured to rub against said helical groove.

11. A charging device according to claim 10, wherein when said movable member moves, said elastic member rubs against said helical groove at least on a side downstream of an engaging position of said projected portion with said helical groove with respect to a movement direction of said movable member.

12. A charging device according to claim 10, wherein said elastic member is disposed so as to face said projected portion through said rotation shaft.

13. A charging device according to claim 10, wherein said movable member includes an urging member configured to urge said projected portion toward said rotation shaft.

14. A charging device according to claim 10, wherein said corona charger includes an air duct forming a flow passage through which inside air thereof is discharged from one end side with respect to a longitudinal direction thereof, and wherein said rotation shaft is disposed inside of said air duct.

15. A charging device according to claim 14, wherein said movable member communicates with said air duct and is provided with a discharge opening through which a deposited matter removed from said helical groove is discharged into said air duct.

16. A charging device according to claim 15, wherein said discharge opening of said movable member is formed below said elastic member with respect to a direction of gravitation.

17. A charging device according to claim 10, wherein said projected portion of said movable member is formed of a non-electroconductive resin material.

18. An image forming apparatus comprising:

a rotatable image bearing member;

a charging device according to claim 10;

a developing device configured to develop an electrostatic latent image formed on said rotatable image bearing member; and a transfer member configured to transfer a toner image formed on said rotatable image bearing member, wherein said charging device is provided downstream of said developing device and upstream of said transfer member with respect to a rotational direction of said rotatable image bearing member.

* * * * *